US010158171B2

(12) United States Patent
Li et al.

(10) Patent No.: US 10,158,171 B2
(45) Date of Patent: Dec. 18, 2018

(54) ANTENNA SYSTEM HAVING DYNAMIC RADIATION PATTERN

(71) Applicant: Commsky Technologies, Inc., Santa Clara, CA (US)

(72) Inventors: Xin Li, Zhejiang (CN); Po-shin Cheng, Fremont, CA (US); Daniel Wang, San Jose, CA (US); Jun Shen, Palo Alto, CA (US); George Zhao, Palo Alto, CA (US)

(73) Assignee: Commsky Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/407,496

(22) Filed: Jan. 17, 2017

(65) Prior Publication Data

US 2017/0222318 A1 Aug. 3, 2017

(30) Foreign Application Priority Data

Jan. 29, 2016 (CN) ..... 2016 1 0067152

(51) Int. Cl.

| | |
|---|---|
| ***H01Q 3/24*** | (2006.01) |
| ***H01Q 15/14*** | (2006.01) |
| ***H01Q 9/28*** | (2006.01) |
| ***H01Q 21/28*** | (2006.01) |
| ***H01Q 5/40*** | (2015.01) |

(52) U.S. Cl.

CPC ..... *H01Q 3/24* (2013.01); *H01Q 5/40* (2015.01); *H01Q 9/28* (2013.01); *H01Q 15/148* (2013.01); *H01Q 21/28* (2013.01)

(58) Field of Classification Search

CPC .. H01Q 3/24; H01Q 5/40; H01Q 9/28; H01Q 21/28; H01Q 15/148

USPC ..... 343/834

See application file for complete search history.

(56) References Cited

U.S. PATENT DOCUMENTS

2011/0080325 A1* 4/2011 Livneh ..... H01Q 3/26 343/702

* cited by examiner

*Primary Examiner* — Andrea Lindgren Baltzell

(74) *Attorney, Agent, or Firm* — Joe Zheng

(57) ABSTRACT

An antenna system having a dynamic radiation pattern is provided. The antenna system comprises at least one antenna unit that includes an antenna dipole, a plurality of reflectors disposed around the antenna dipole, and a plurality of switches each corresponding to one of the reflectors. Each of the switches is coupled between the corresponding reflector and an electrical ground of the antenna system. The antenna system further includes a control unit configured to dynamically change a radiation pattern of the antenna system by controlling the plurality of switches.

12 Claims, 16 Drawing Sheets

ANTENNA SYSTEM HAVING DYNAMIC RADIATION PATTERN

CROSS-REFERENCE TO RELATED APPLICATIONS

The present disclosure claims the priority benefit of Chinese Patent Application No. 201610067152.2, filed on 29 Jan. 2016, which is incorporated by reference in its entirety.

TECHNICAL FIELD

The present disclosure relates to wireless communication, and in particular, to an intelligent antenna system having a dynamic radiation pattern.

BACKGROUND

An antenna system is an indispensable element in wireless communication. For conventional wireless communication, only one antenna is used at a transmitting end, and only one antenna is used at a receiving end, resulting in a single-input-single-output (SISO) communication system. A SISO system is typically subject to a problem of so-called "multipath interference". That is, an electromagnetic (EM) wave transmitted from the antenna at the transmitting end, while propagating from the transmitting end to the receiving end, may be split into multiple components each propagating in a respectively different path between the transmitting end and the receiving end. The splitting of the EM wave may be due to reflection, deflection, refraction and/or scattering of the EM wave by various objects such as hills, valleys, buildings, electrical cables and electrical transmission towers. Each component of the EM wave may arrive at the receiving end at a different time, interfering with each other and causing undesirable communication phenomena such as signal attenuation, edge fall-off (i.e., "cliff effect") and intermittent reception (with the received signal having a "picket fence" pattern in time). For digital communication systems such as the Internet, such undesirable communication phenomena would lower a data transmission rate and/or increase a bit error rate (BER) thereof.

The issues resulted from multipath interference may be mitigated or solved by an introduction of an intelligent antenna, which is an antenna system for digital wireless communication. The intelligent antenna exhibits prominent advantages manifested in diversity at both the transmitting end and the receiving end. That is, several radio frequency (RF) signals may be transmitted from the transmitting end at the same time, and/or several RF signals may be received at the receiving end at the same time. This approach of transmitting and/or receiving multiple RF signals at the same time may enhance data transmission rate and reduce BER of the digital communication. An intelligent antenna is also referred to as a self-adaptive array antenna, a multi-antenna, or a multi-input-multi-output (MIMO) antenna. Through an intelligent signal processing algorithm, the array antenna is able to recognize a direction of arrival (DOA) and other characteristics of an incoming EM wave, based on which a corresponding outgoing EM wave can be calculated or otherwise determined. Furthermore, through a control unit which is configured to control the outgoing EM wave, the intelligent antenna or the array antenna is able to track and position a moving target.

A majority of existing "intelligent" antenna systems employ the conventional MIMO structure that enhances system performances and reduces BER by transmission diversity (i.e., diversity at the transmission end) and receiving diversity (i.e., diversity at the receiving end). However, each antenna thereof is still non-intelligent. Moreover, antennas of an existing intelligent antenna system are typically omnidirectional, having a lower antenna gain and a weaker directional coverage in general. Unless laid out precisely, the antennas are often subject to problems such as signal instability.

Therefore, it is needed to invent a truly intelligent antenna system of which a directional pattern (i.e., the radiation pattern) can be dynamically controlled.

SUMMARY

This section is for the purpose of summarizing some aspects of the present disclosure and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present disclosure.

One object of the present disclosure is to provide an improved antenna system having certain intelligence. Specifically, the intelligence of the antenna system is manifested in a dynamic radiation pattern with which the antenna system is able to transmit an EM wave for wireless communication purposes.

According to one aspect of the present disclosure, the present disclosure provides an antenna system. The antenna system may include one or more antenna units. Each of the antenna units of the antenna system may include an antenna dipole, as well as a plurality of reflectors disposed around the antenna dipole. Each of the antenna units of the antenna system may also include a plurality of switches. Each of the plurality of switches may be corresponding to a respective one of the plurality of reflectors, and may also couple the respective one of the plurality of reflectors to an electrical ground of the antenna system. The antenna system may also include a control unit that is configured to change a radiation pattern of the antenna system by controlling the plurality of switches of each of the plurality of antenna units of the antenna system.

One of the features, benefits and advantages in the present disclosure is to provide techniques for providing an intelligent antenna system having a dynamic radiation pattern. Compared to a conventional antenna system, the intelligent antenna system disclosed in the present disclosure is able to transmit an EM wave with a radiation pattern that is dynamically controlled by the intelligent antenna system.

Other objects, features, and advantages of the present disclosure will become apparent upon examining the following detailed description of an embodiment thereof, taken in conjunction with the attached drawings.

BRIEF DESCRIPTION OF THE DRAWINGS

These and other features, aspects, and advantages of the present disclosure will become better understood with regard to the following description, appended claims, and accompanying drawings.

DETAILED DESCRIPTION OF THE PREFERRED EMBODIMENTS

The detailed description of the present disclosure is presented largely in terms of procedures, steps, logic blocks, processing, or other symbolic representations that directly or indirectly resemble the operations of devices or systems contemplated in the present disclosure. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the present disclosure. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the present disclosure do not inherently indicate any particular order nor imply any limitations in the present disclosure. In addition, reference herein to "couple to", "coupled to" or "coupling to" means a direct or indirect electrical connection.

Figure 11A:
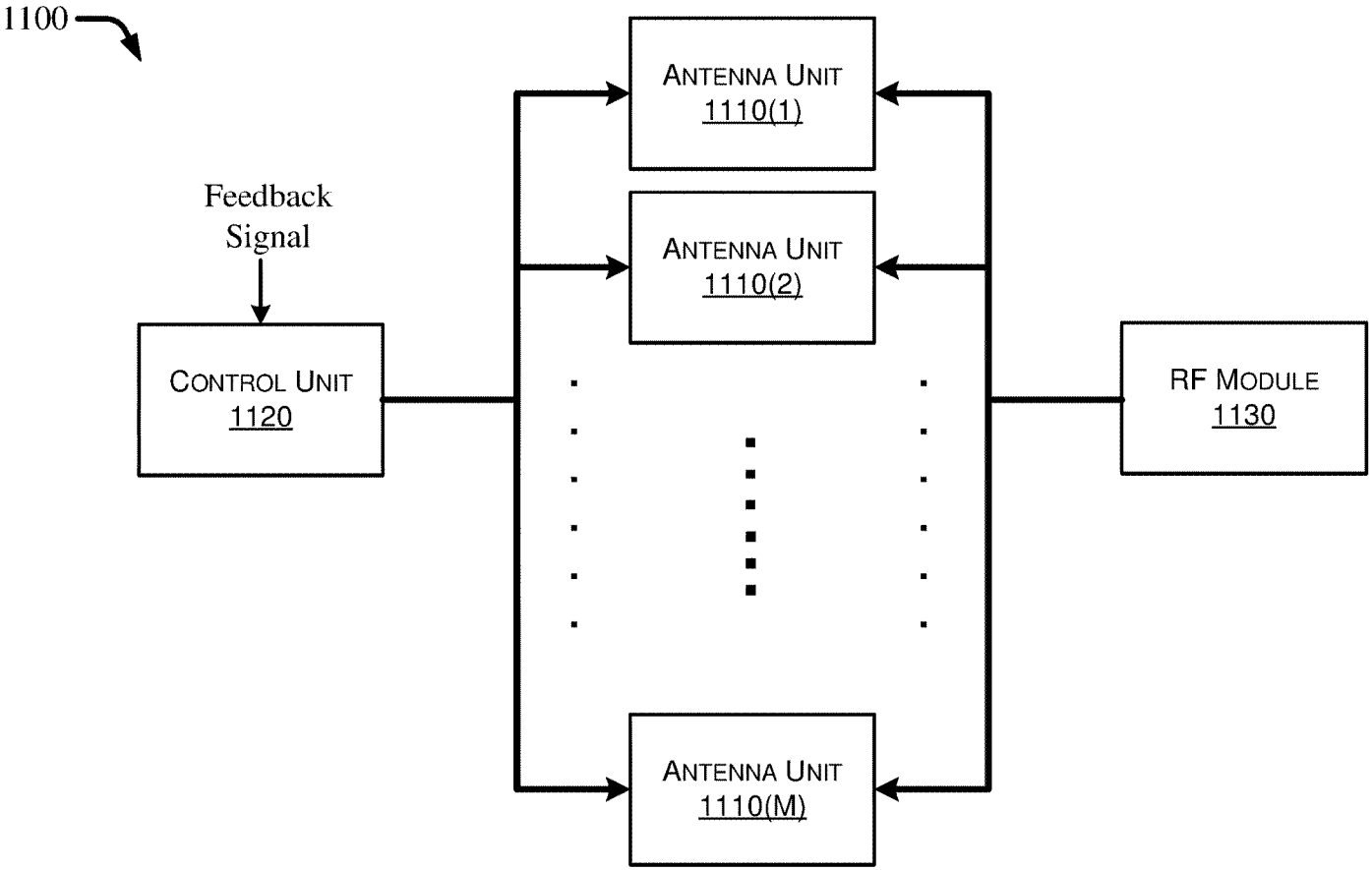
FIG. 11A is a block diagram of an intelligent antenna system according to an embodiment of the present disclosure.

FIG. 11A is a block diagram of an intelligent antenna system 1100 according to an embodiment of the present disclosure. As shown in FIG. 11A, intelligent antenna system 1100 includes at least one antenna unit (such as antenna unit 1110(1)), a control unit 1120, as well as a RF module 1130. In some embodiments, intelligent antenna system 1100 may include M antenna units, shown in FIG. 11A as antenna units 1110(1), 1110(2), . . . , 1110(M), with M being a positive integer greater than or equal to 1. The value of M (i.e., the total number of antenna units that antenna system 1100 has), which may be 1,2 or more, may be determined depending on actual requirements of antenna system 1100. RF module 1130 is configured to drive antenna units 1110(1)-1110(M) to transmit or emit EM waves.

Figure 11B:
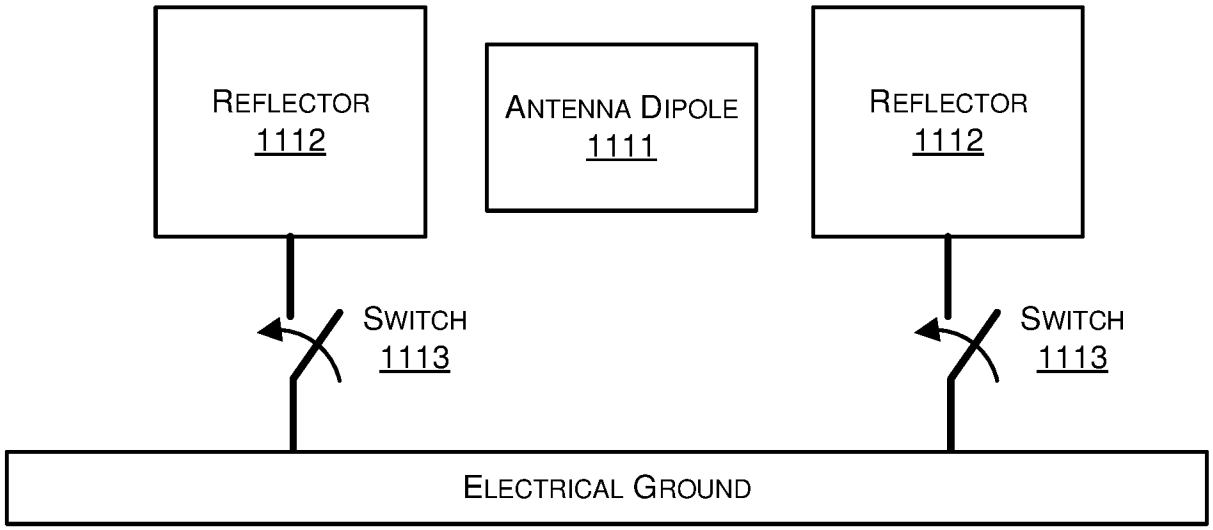
FIG. 11B is a block diagram of an antenna unit of the intelligent antenna system of FIG. 11A.

Each of antenna units 1110(1)-1110(M) of FIG. 11A may include functional blocks as shown in FIG. 11B. As shown in FIG. 11B, each of antenna units 1110(1)-1110(M) may include an antenna dipole 1111, a plurality of reflectors 1112 surrounding antenna dipole 1111, and a plurality of switches 1113 each corresponding to a respective one of reflectors 1112. Each of switches 1113 may be a two-terminal device having a first terminal and a second terminal, and may couple to the corresponding one of reflectors 1112 on the first terminal thereof, and to an electrical ground of antenna system 1110 on the second terminal thereof.

Each of the plurality of switches 1113 may have an ON state and an OFF state. When a switch of the plurality of switches 1113 is turned on (i.e., placed in the ON state), the corresponding reflector of the plurality of reflectors 1112 is electrically coupled to the electrical ground, thereby configured to reflect effectively an EM wave radiated from antenna dipole 1111. In contrast, when the switch of the plurality of switches 1113 is turned off (i.e., placed in the OFF state), the corresponding reflector of the plurality of reflectors 1112 is electrically disconnected from the electrical ground, not able to reflect effectively the EM wave radiated from antenna dipole 1111. Consequently, this may result in a change in a radiation pattern of antenna system 1110 through turning on or off the switch of the plurality of switches 1113.

Control unit 1120 of FIG. 11A may be configured to control each of antenna units 1110(1)-1110(M). Specifically, control unit 1120 may be configured to individually control (i.e., to turn on or off) each of the switches 1113 of each of antenna units 1110(1)-1110(M) such that each of the corresponding reflectors 1112 may be individually placed in a reflection state either to reflect effectively, or not to reflect effectively, an EM wave radiated from an antenna dipole 1111 near the reflector. Through control unit 1120 controlling individual reflectors of antenna system 1100 to collectively reflect EM waves radiated from antenna units 1110(1)-1110(M) in a certain way, a certain radiation pattern of antenna system 1100 may be realized. A change in the reflection state of any reflector may result in a change in the radiation pattern of antenna system 1110. Accordingly, the radiation pattern of antenna system 1100 may be thereby controlled dynamically and flexibly, realizing intelligence in antenna system 1100.

The plurality of switches 1113 may be controlled by control unit 120 to collectively realize various on-off combinations of the plurality of switches 1113, and each of the on-off combinations may result in a correspondingly different radiation pattern of antenna system 1100. Namely, the various on-off combinations of switches 1113 may result in various radiation patterns of antenna system 1100 which are different from each other. In some embodiments, antenna system 1100 may have a total number of n reflectors, with n being a positive integer greater than or equal to 2. Consequently, the plurality of switches 1113 may collectively realize a total number of $2^n$ on-off combinations, which translate to a total number of $2^n$ radiation patterns of antenna system 1100. For example, when n equals to 3, switches 1113 may realize 8 different on-off combinations, and antenna system 1100 may thus have 8 different radiation patterns.

In a preferred embodiment, control unit 1120 may operate in either a dynamic scanning mode or a normal working mode. When control unit 1120 operates in the dynamic scanning mode, control unit 1120 may control switches 1113 such that antenna system 1100 "scans through" all the various radiation patterns that may be realized by all the various on-off combinations of the plurality of switches 1113. That is, control unit 1120 may configure of the plurality of switches 1113 to realize one on-off combination at a time, and successively go through all the various on-off combinations that may be realized by the plurality of switches 1113. For each on-off combination, antenna system 1100 may transmit EM waves with the particular radiation pattern corresponding to the particular on-off combination. With control unit 1120 operating in the dynamic scanning mode, a wireless communication device having antenna system 1100 (such as a Wi-Fi router) may conduct wireless communication with a terminal device (such as a smartphone, a computer, a tablet, or the like), and antenna system 1100 may thus obtain feedback signals from the terminal device while scanning through all the various radiation patterns. Based on the feedback signals from the terminal device while scanning all the various radiation patterns, antenna system 1100 may further determine an optimal radiation pattern among all the various radiation patterns, as well as a corresponding optimal on-off combination of the plurality of switches 1113, that are most suitable for the wireless communication device to use in conducting the wireless communication with the terminal device. For example, the optimal radiation pattern may be determined to be a certain radiation pattern, among all the various radiation patterns, that results in a feedback signal that has a highest received signal strength indicator (RSSI), and the optimal on-off switch combination may be determined to be the corresponding on-off combination of switches 1113 that corresponds to the certain radiation pattern. When control unit 1120 operates in the normal working mode, control unit 1120 may then place switches 1113 according to the optimal on-off combination, and thus antenna system 1110 may transmit EM waves with the optimal radiation pattern, which is determined to be the most suitable for the terminal device. Accordingly, antenna system 1100 may be able to provide a most suitable radiation pattern for the terminal device regardless of a physical location of the terminal device. Accordingly, quality and speed of the wireless communication thereof may be enhanced.

In another preferred embodiment, control unit 1120 may operate alternatively in the dynamic scanning mode and in the normal operating mode (i.e., back and forth between the two modes). Therefore, even if the terminal device is physically moving relative to the wireless communication device, antenna system 1100 of the wireless communication device may still maintain an optimal radiation pattern throughout the moving process. The optimal radiation pattern may be constantly changing or otherwise being updated according to the real-time physical location of the terminal device during the moving process.

Figure 1:
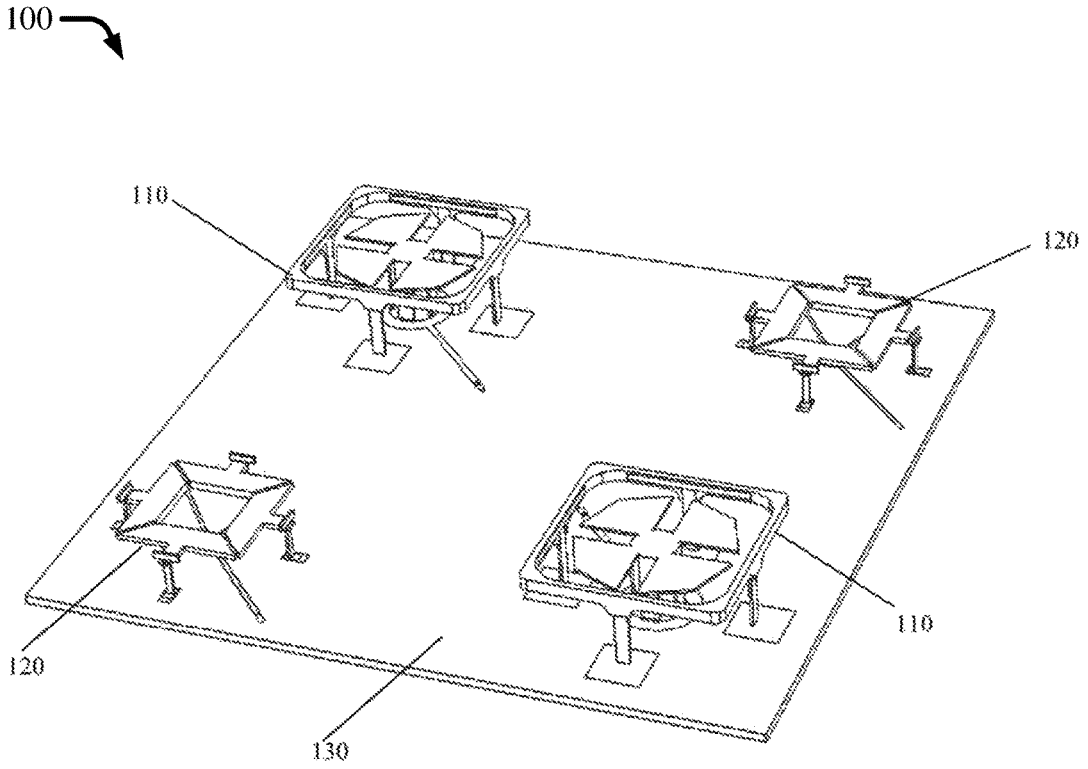
FIG. 1 is a perspective view of an intelligent antenna system according to an embodiment of the present disclosure.
Figure 2:
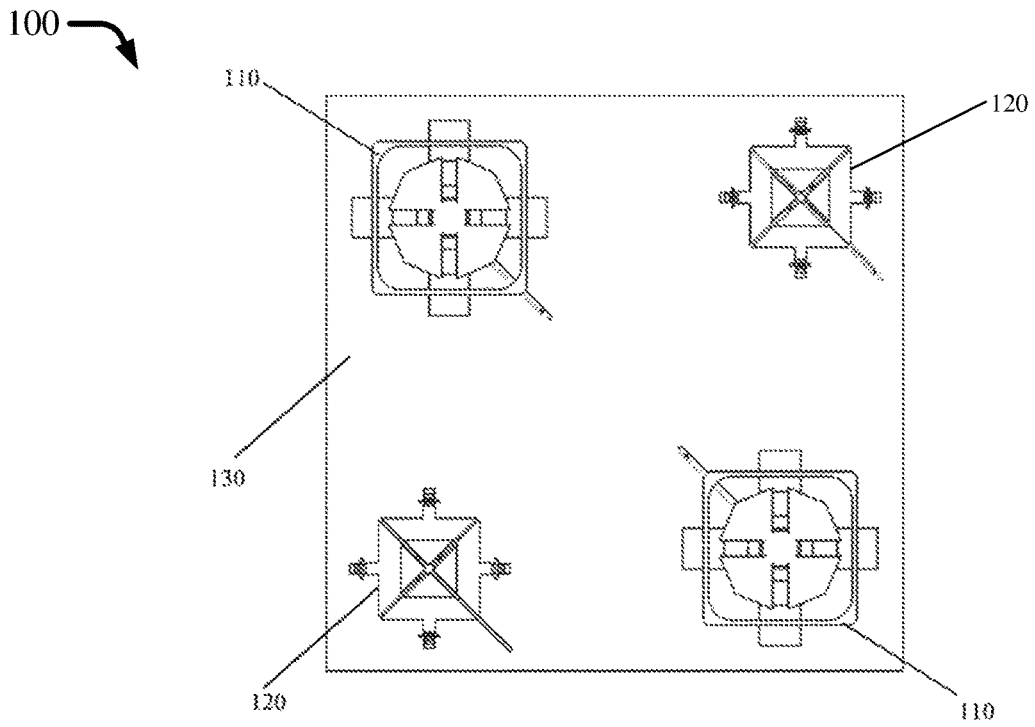
FIG. 2 is a top view of the intelligent antenna system of FIG. 1.
Figure 3:
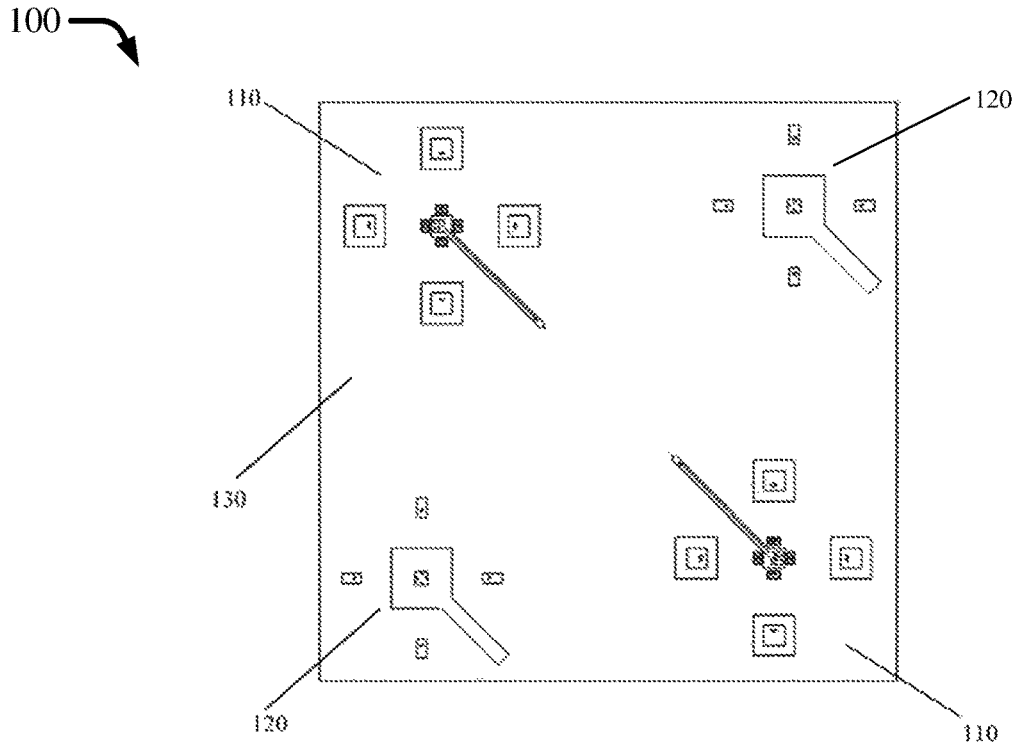
FIG. 3 is a bottom view of the intelligent antenna system of FIG. 1.

Refer to FIGS. 1-3, wherein FIG. 1 shows a perspective view of an intelligent antenna system 100 according to an embodiment of the present disclosure, wherein FIG. 2 shows a top view of intelligent antenna system 100 of FIG. 1, and wherein FIG. 3 shows a bottom view of intelligent antenna system 100 of FIG. 1. As shown in FIGS. 1-3, antenna system 100 includes a substrate 130, two (2) first antenna units 110, and two (2) second antenna units 120. In some embodiments, first antenna units 110 may operate at a first frequency, and second antenna units 120 may operate at a second frequency. For example, the first frequency may be 2.4 gigahertz (GHz), and the second frequency may be 5 GHz. Namely, antenna system 100 may support dual-band communication.

As shown in FIG. 1-3, antenna system 100 is designed to fit a 2×2 (i.e., 2-by-2) MIMO Wi-Fi structure, as each kind of antenna units (i.e., first antenna units 110 and second antenna units 120) has two identical antenna units. Notably, antenna system 100 may be easily modified (e.g., by increasing the number of identical antenna units of each kind of antenna units to 3) to fit a 3×3 (i.e., 3-by-3) MIMO Wi-Fi structure. Those skilled in the art would easily modify antenna system 100 for an N×N (i.e., N-by-N) MIMO hardware structure.

As disclosed previously, antenna system 100 may have operation bands that cover a band of 2.4 GHz and a band of 5 GHz. Each band may be realized by two independent antenna units that are polarized orthogonally (i.e., each of the two independent antenna units may have a respective radiation polarization direction, and the two radiation polarization directions of the two independent antenna units are perpendicular to one another). The antenna units of each band may be positioned according to a respective layout, and driven by a respective RF module. Moreover, the antenna units may take very little space on substrate 130. For example, antenna unit may be realized by one or more bended metal strips that are directly soldered to substrate 130, which may be a printed circuit board (PCB). An integral height of each of the antenna units may be 12 mm or less.

Figure 4A:
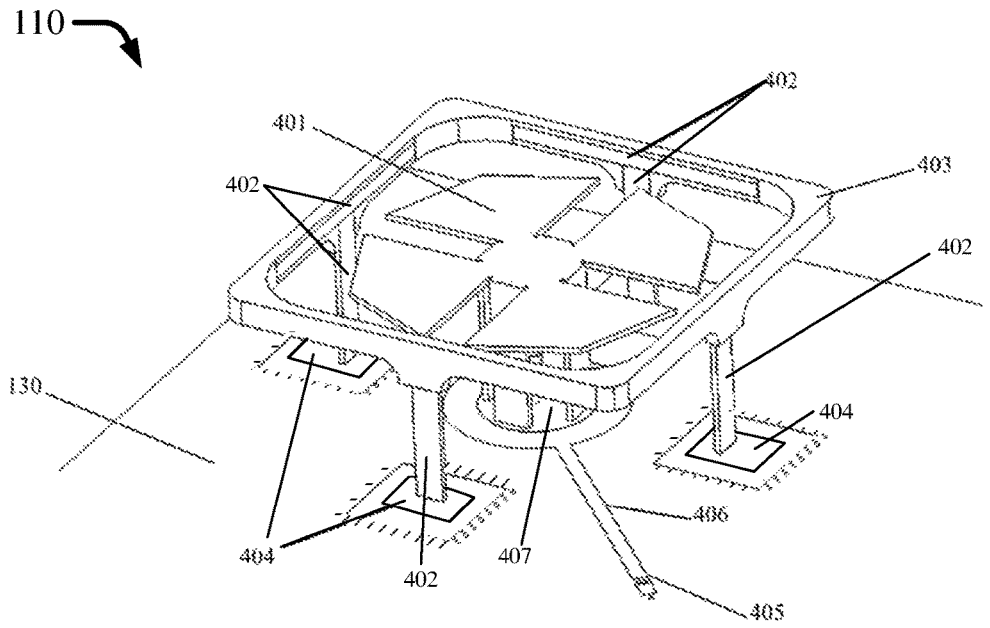
FIG. 4A is a top perspective view of a first antenna unit of the intelligent antenna system of FIG. 1.
Figure 4B:
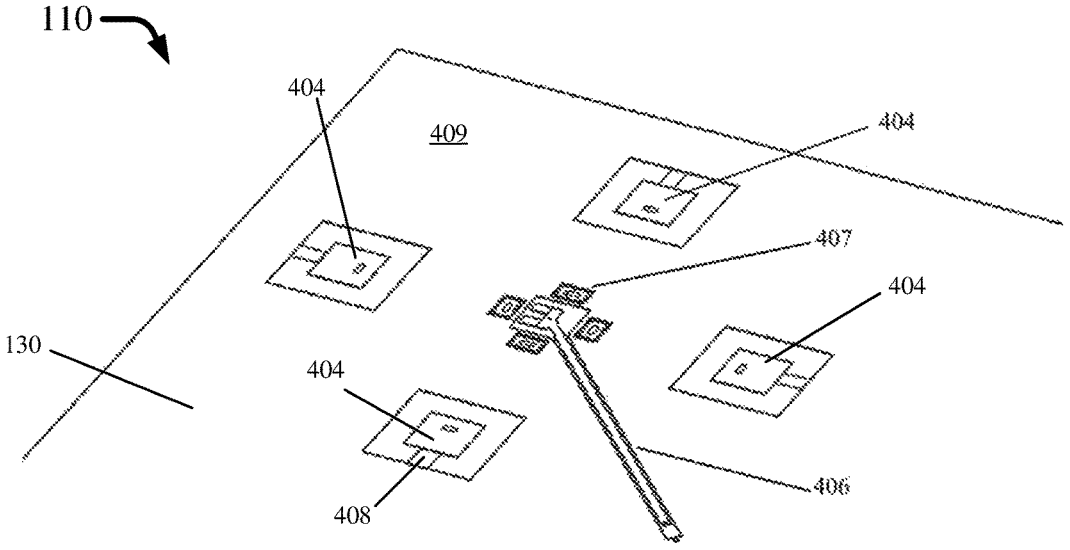
FIG. 4B is a bottom perspective view of the first antenna unit of FIG. 4A.

FIGS. 4A and 4B respectively show a top perspective view and a bottom perspective view of one of the first antenna units 110 of FIG. 1. The first antenna unit 110 shown in FIGS. 4A and 4B may include an antenna dipole 401 disposed on substrate 130, four reflectors 402 (two of which are more visible than the other two in FIG. 4A), as well as a fixing device 403. Fixing device 403 may be made of electrically non-conductive material, and may be configured to hold or maintain each of reflectors 402 at a respective position, preventing a change of the respective position in relation to antenna dipole 401. In addition, reflectors 402 may be uniformly disposed around antenna dipole 401, with one of reflectors 402 disposed every 90 degrees surrounding antenna dipole 401, as shown in FIG. 4A. Each of reflectors 402 may be disposed at a same distance from antenna dipole 401.

In some embodiments, antenna dipole 401 and reflectors 402 may be realized by metal pieces or strips that are bent with impulse pressure. As shown in FIG. 4A, an end of antenna dipole 401 may be soldered with a dipole soldering pad 407, and an end of each of reflectors 402 may be respectively soldered with a reflector soldering pad 404. First antenna unit 110 may be powered through an electrical feeding system that includes a transmission line 406 and a feeding point 405 that are coupled to dipole soldering pad 407. For a normal operation of antenna system 100, it is imperative that first antenna unit 110 has a radiation pattern and an input impedance that each is within a respective desired range. In some embodiments, the input impedance of first antenna unit 110 may be well matched at 50 ohms through adjusting a width and an electrical length of transmission line 406.

It is to be noted that reflectors 402 are not directly connected with an electrical ground 409 of antenna unit 110 (hereinafter "ground 409"). As shown in FIGS. 4A and 4B, through conductor proliferation on all four sides of reflector soldering pads 404, each of reflector soldering pads 404 (with which a reflector 402 is respectively soldered) is electrically separated from ground 409 of antenna unit 110. That is, there lacks a direct electrical connection between each of reflector soldering pads 404 and ground 409. Instead, each of reflectors 402 is coupled to ground 409 through a respective diode (such as diode 408 shown in FIG. 4B), which serves as a switch to turn on and off the respective reflector 402.

A diode is a two-terminal electronic device that has an asymmetrical electrical conductance. That is, when an electrical current flows in a positive direction (i.e., passing through the diode from a first terminal of the diode to a second terminal of the diode), the diode exhibits a very low (ideally, zero) resistance value. On the contrary, when an electrical current flows in a negative direction opposite to the positive direction (i.e., passing through the diode from the second terminal to the first terminal), the diode exhibits a very high (ideally, infinite) resistance value. Accordingly, a common function for a diode to perform is to allow an electrical current to flow in the positive direction (i.e., a forward direction of the diode) but to block an electrical current from flowing in the negative direction (i.e., a reverse direction of the diode). At present, a commonly used diode is a semiconductor diode that includes a p-n junction fabricated on a semiconductor substrate. The semiconductor diode may be used as an electrical switch. For example, a plurality of such semiconductor diodes may be used to implement switches 1113 of FIG. 11B. Diode 408 of FIG. 4B may also be a semiconductor diode.

As described above and shown in FIGS. 4A and 4B, the two terminals of diode 408 may couple to ground 409 and a reflector 402, respectively. Therefore, whether or not an electrical connection is established between the reflector 402 and ground 409 may be controlled by how diode 408 is biased, and the radiation pattern of first antenna unit 110 of FIG. 4A may be changed accordingly. Specifically, when diode 408 is biased to allow an electrical current to pass through diode 408 in the forward direction, the resistance of diode 408 is very low, and thus diode 408 is close to a "short circuit". Hence, reflector 402 is substantially coupled to ground 409 electrically, and contributes to the radiation pattern of first antenna unit 110 of FIG. 4A. On the other hand, when diode 408 is biased such that an electrical current is blocked and not allowed to pass through diode 408 in the forward direction, the resistance of diode 408 is very high, and thus diode 408 is close to an "open circuit". Hence, reflector 402 is substantially decoupled from ground 409 electrically, and has little contribution to the radiation pattern of first antenna unit 110 of FIG. 4A. As shown in FIG. 4A, first antenna unit 110 has four reflectors 402, and thus four diodes may be used as switches between reflectors 402 and ground 409, each diode for one of the reflectors 402. Theoretically, the four switches may have $2^4=16$ different on-off combinations, and thus first antenna unit 110 of FIG. 4A may be configured to transmit EM waves with one of $2^4=16$ different radiation patterns, with each on-off combination corresponding to a respectively different radiation pattern thereof.

Figure 5A:
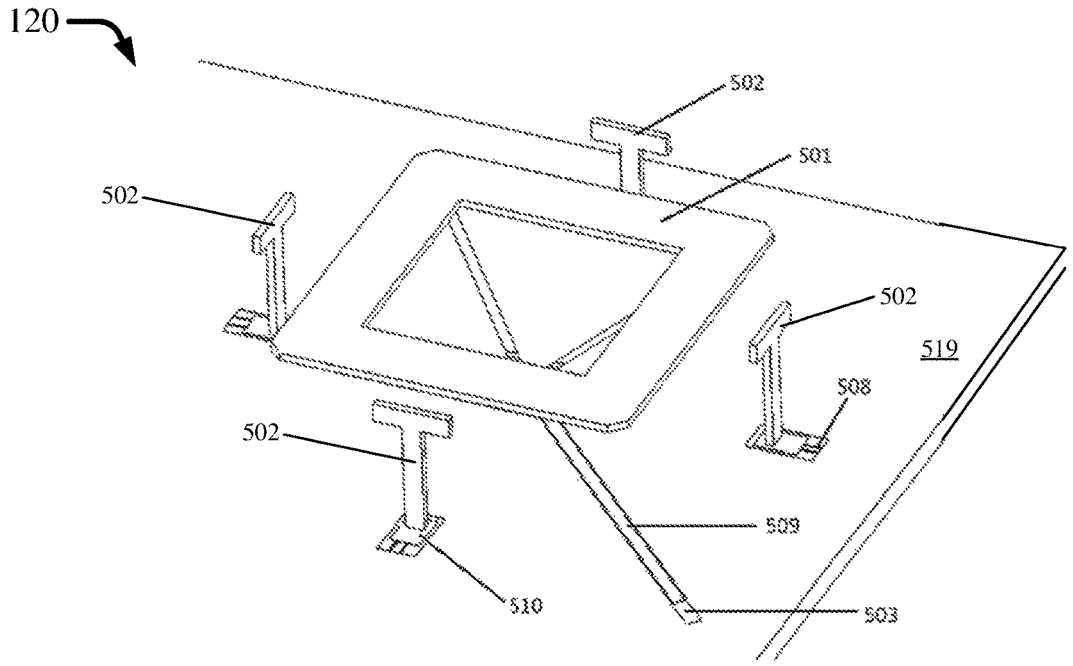
FIG. 5A is a top perspective view of a second antenna unit of the intelligent antenna system of FIG. 1, the second antenna unit not including a fixing device.
Figure 5B:
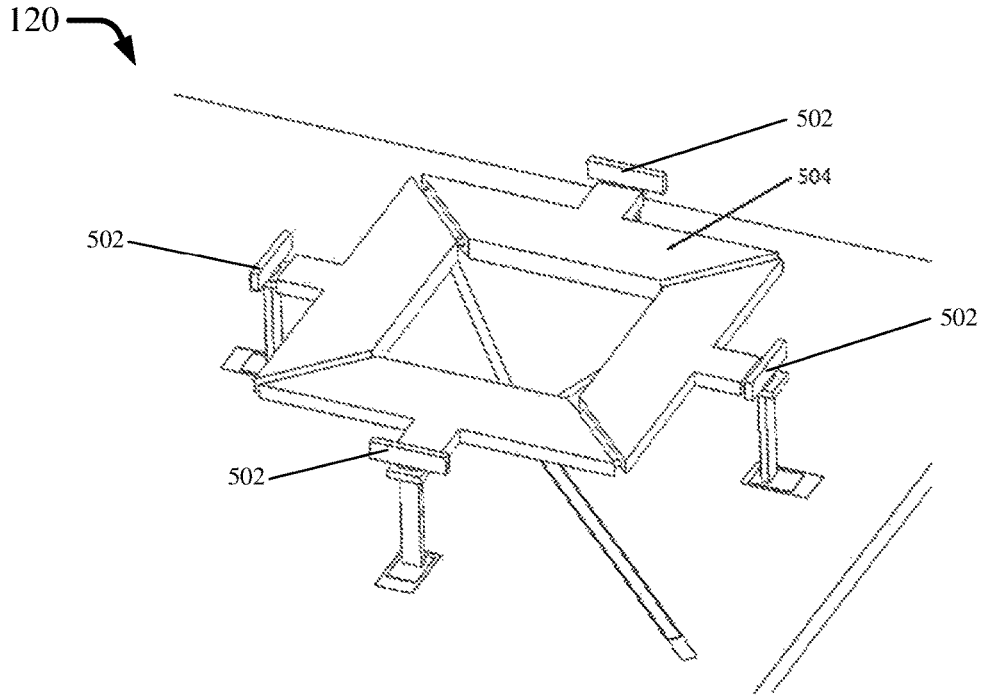
FIG. 5B is a top perspective view of a second antenna unit of the intelligent antenna system of FIG. 1, the second antenna unit including a fixing device.
Figure 5C:
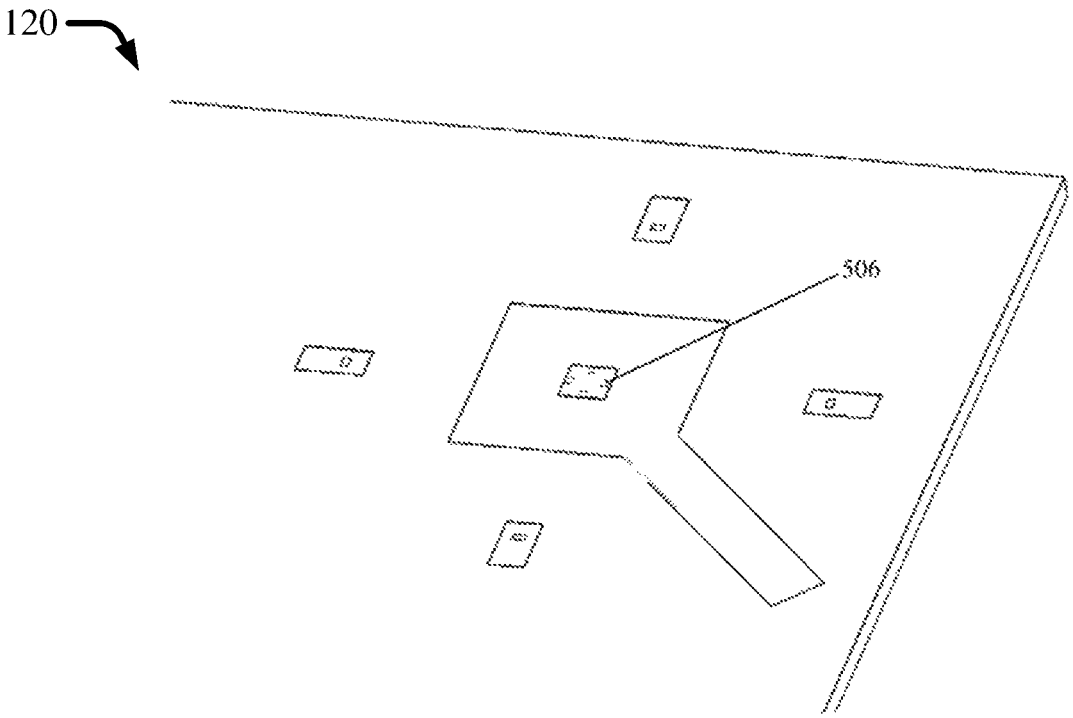
FIG. 5C is a bottom perspective view of a second antenna unit of the intelligent antenna system of FIG. 1.

Each of FIGS. 5A and 5B shows a top perspective view of a second antenna unit 120 of antenna system 100 of FIG. 1. FIG. 5B includes a fixing device 504, whereas FIG. 5A does not include a fixing device. FIG. 5C shows a bottom perspective view of a second antenna unit 120 of antenna system 100 of FIG. 1. As shown in one or more of FIGS. 5A, 5B and 5C, and similar to the first antenna 110 shown in FIGS. 4A and 4B, second antenna unit 120 may include an antenna dipole 501, four reflectors 502, as well as a fixing device 504. Fixing device 504 may be made of electrically non-conductive material, and may be configured to hold or maintain each of reflectors 502 at a respective position, preventing a change of the respective position in relation to antenna dipole 501. In addition, reflectors 502 may be uniformly disposed around antenna dipole 501, with one of reflectors 502 disposed every 90 degrees surrounding antenna dipole 501, as shown in FIG. 5A. Each of reflectors 502 may be disposed at a same distance from antenna dipole 501.

In some embodiments, fixing device 504 may be used to connect antenna dipole 501 and reflectors 502 to form an integral part, so that reflectors 502 may be accurately disposed in relation to antenna dipole 501 as designed. Meanwhile, the integral part having both antenna dipole 501 and reflectors 502 may facilitate an easy assembly of the second antenna unit 120 of antenna system 100. It would be easily understood by those skilled in the art to modify reflectors 502 according to detailed description thereof provided by the present disclosure.

As shown in FIGS. 5A and 5B, and similar to reflectors 402 of the first antenna unit 110 shown in FIGS. 4A and 4B, reflectors 502 of the second antenna unit 120 are not directly connected with an electrical ground 519 of antenna unit 120 (hereinafter "ground 519"). Also similarly, each of reflectors 502 is coupled to ground 519 through a respective diode (such as diode 508 as shown in FIG. 5A), which serves as a switch to turn on and off the respective reflector 502. The function of diode 508 is same as that of diode 408 described previously, and is not repeated herein. It is shown in FIG. 5A that second antenna unit 120 has four reflectors 502, and thus four diodes 508 may be used as switches between reflectors 502 and ground 519, each diode for one of the reflectors 502. Theoretically, the four switches may have $2^4=16$ different on-off combinations, and thus second antenna unit 120 of FIG. 5A may be configured to transmit EM waves with one of $2^4=16$ different radiation patterns, with each on-off combination corresponding to a respectively different radiation pattern thereof.

For a normal operation of antenna system 100, it is imperative that second antenna unit 120 has a radiation pattern and an input impedance that each is within a respective desired range. As shown in FIGS. 5A, 5B and 5C, the second antenna unit 120 may be powered through an electrical feeding system that includes a transmission line 509 and a feeding point 503. In some embodiments, the input impedance of second antenna unit 120 may be well matched at 50 ohms through adjusting a width and an electrical length of transmission line 509. Also as shown in one or more of FIGS. 5A, 5B and 5C, the second antenna unit 120 may also include dipole soldering pad 506 and reflector soldering pads such as soldering pad 510.

Each of FIGS. 6, 7A-7D, 8A-8F, 9A-9D and 10 shows one of the 16 respectively different radiation patterns mentioned above on a horizontal plane of an antenna. The horizontal plane is defined as a plane parallel to a primary plane of the antenna unit. For example, the horizontal plane of first antenna unit 110 of FIG. 4A may be a plane parallel to substrate 130 thereof. As another example, the horizontal plane of second antenna unit 120 of FIG. 5A may be a plane parallel to antenna dipole 501 thereof. A radiation pattern on a horizontal plane is referred to as "horizontal radiation pattern" hereinafter.

Figure 6:
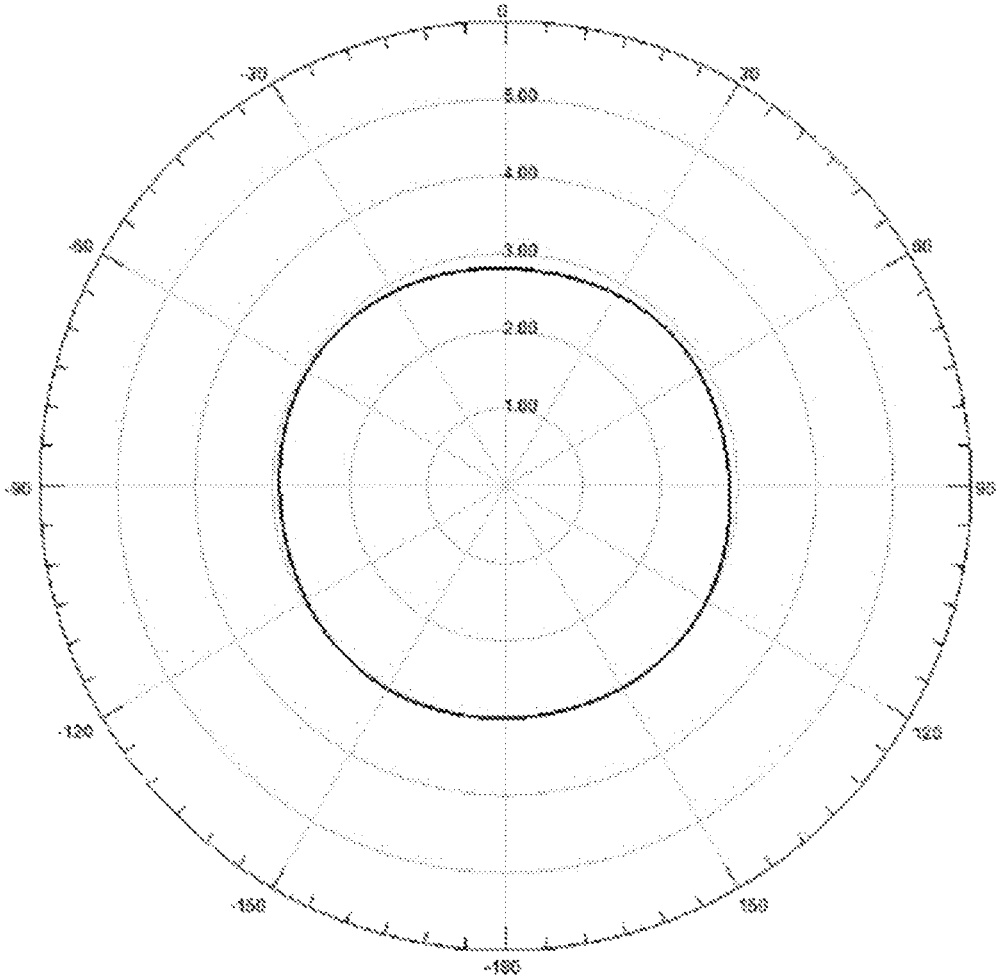
FIG. 6 shows a horizontal radiation pattern of an antenna unit of the intelligent antenna system of FIG. 1 when no reflector of the antenna unit is grounded.
Figure 7A:
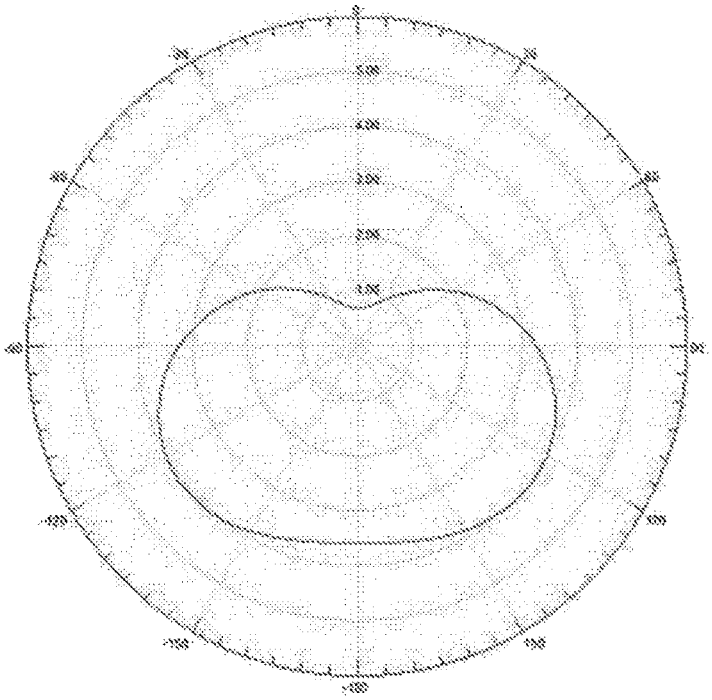
FIGS. 7A-7D each shows a respective horizontal radiation pattern of an antenna unit of the intelligent antenna system of FIG. 1 when none but one reflector of the antenna unit is grounded.
Figure 7B:
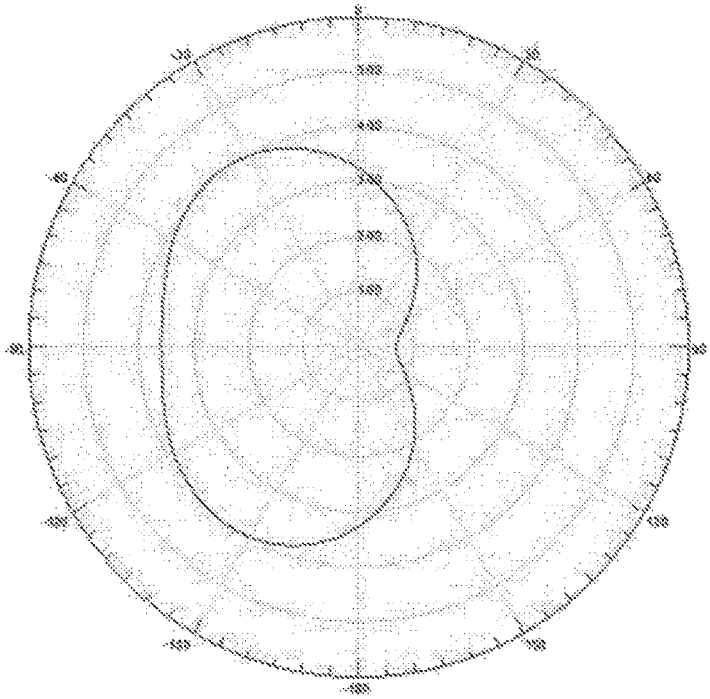
Figure 7C:
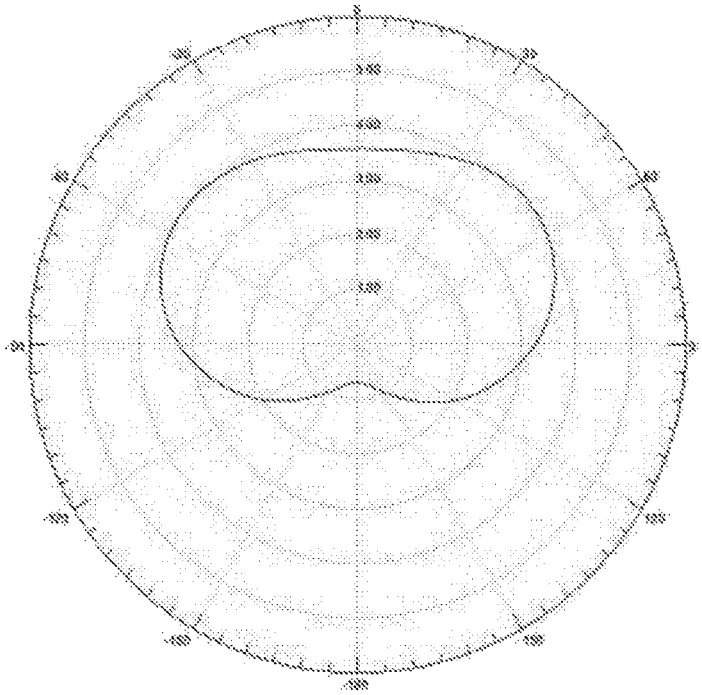
Figure 7D:
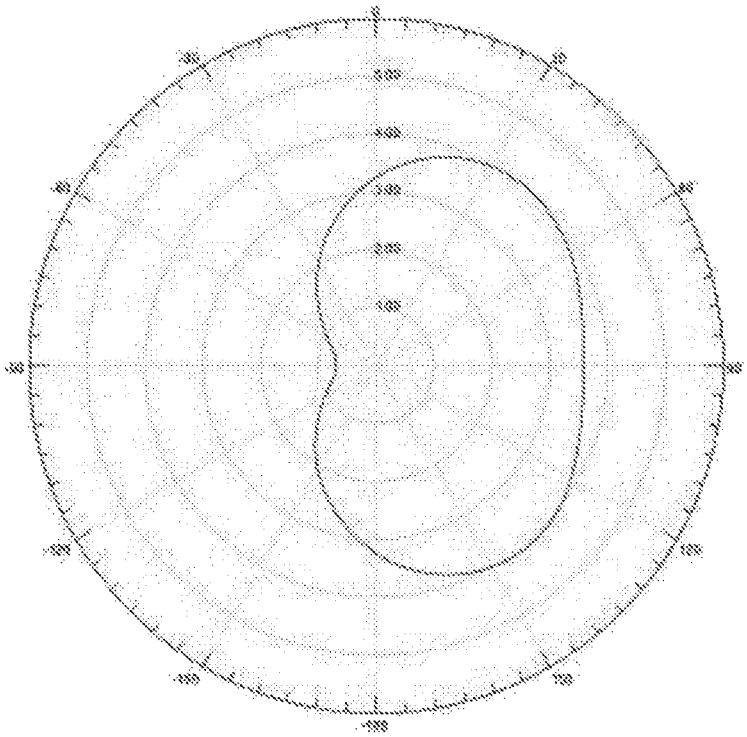
Figure 8A:
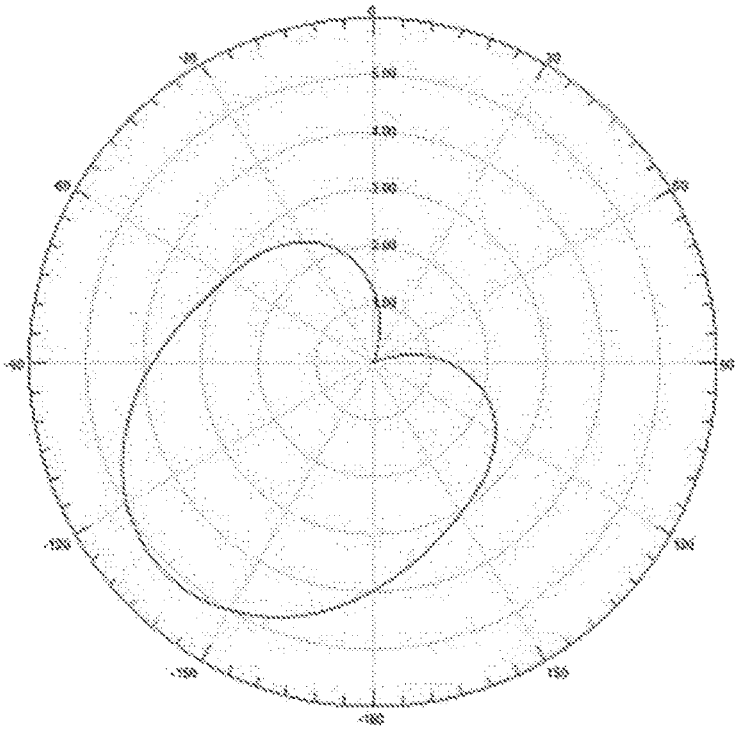
FIGS. 8A-8F each shows a respective horizontal radiation pattern of an antenna unit of the intelligent antenna system of FIG. 1 when two reflectors of the antenna unit are grounded and two other reflectors of the antenna unit are not grounded.
Figure 8B:
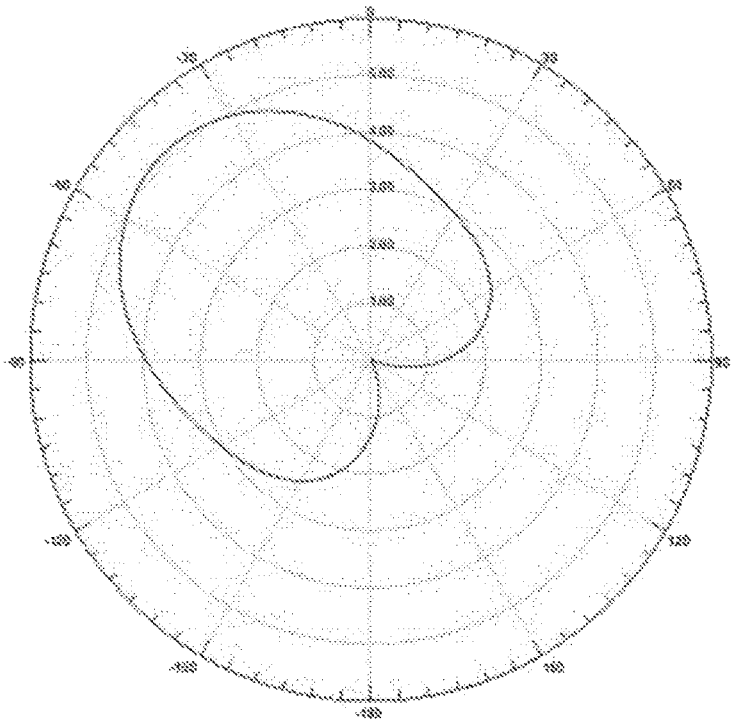
Figure 8C:
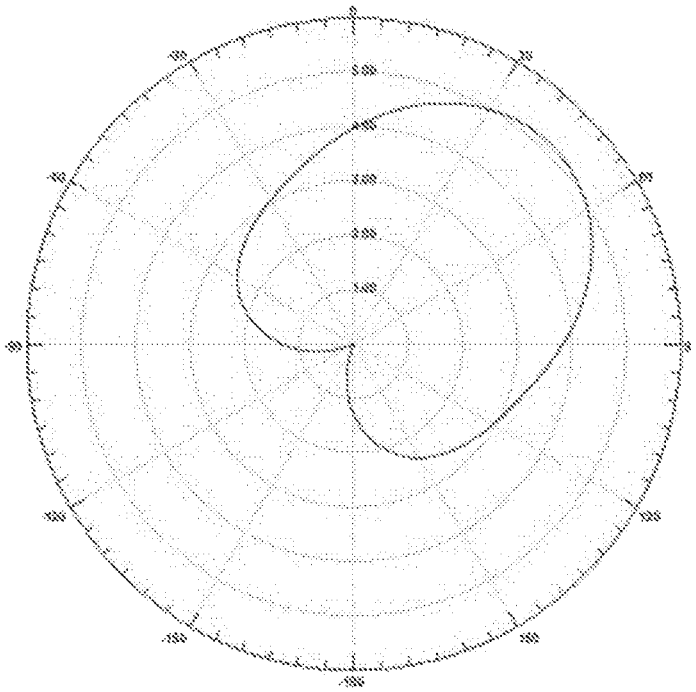
Figure 8D:
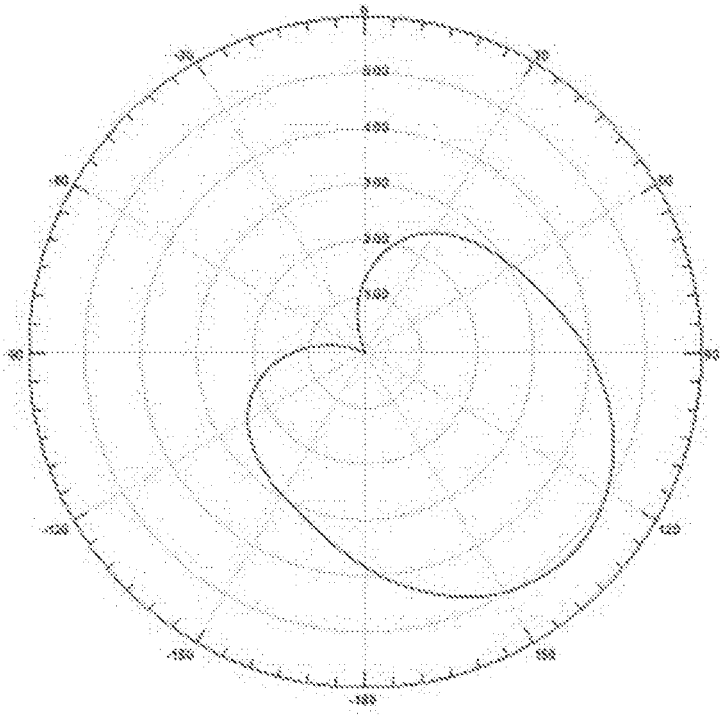
Figure 8E:
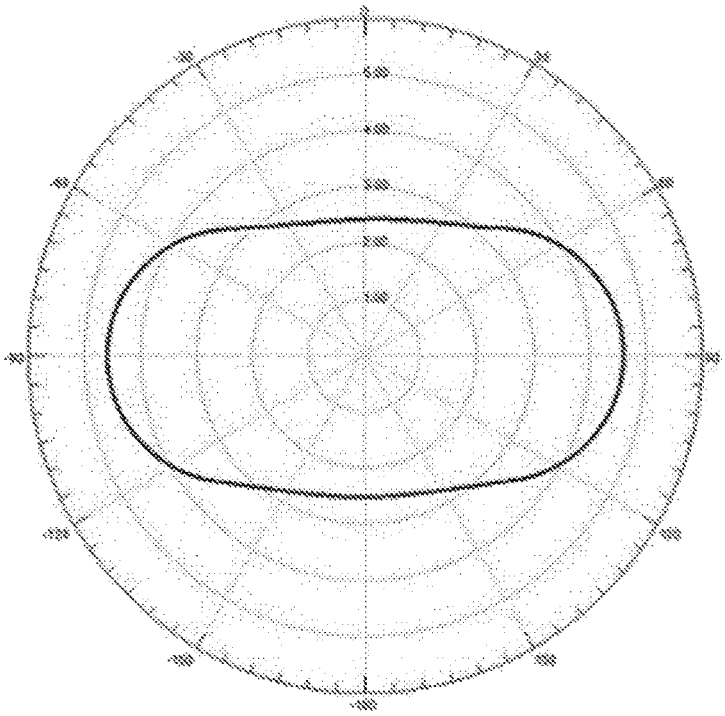
Figure 8F:
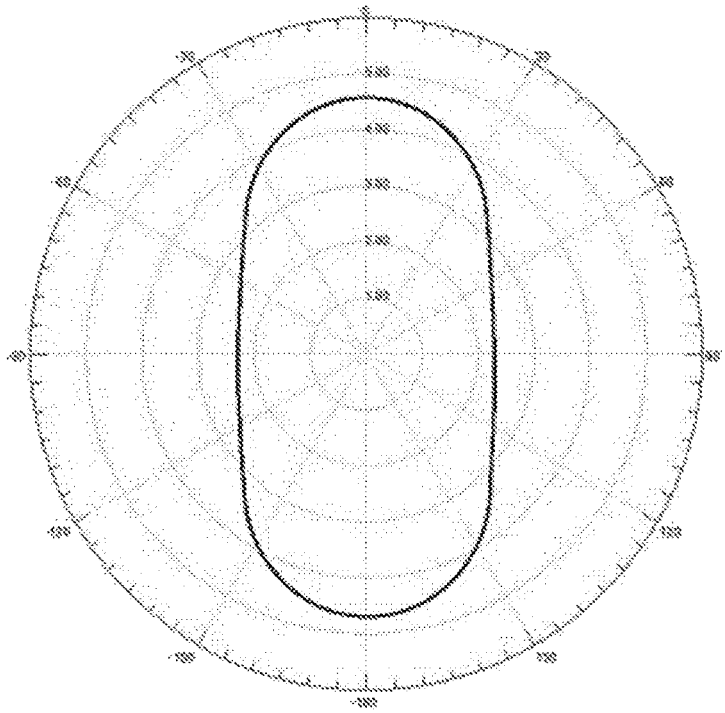
Figure 9A:
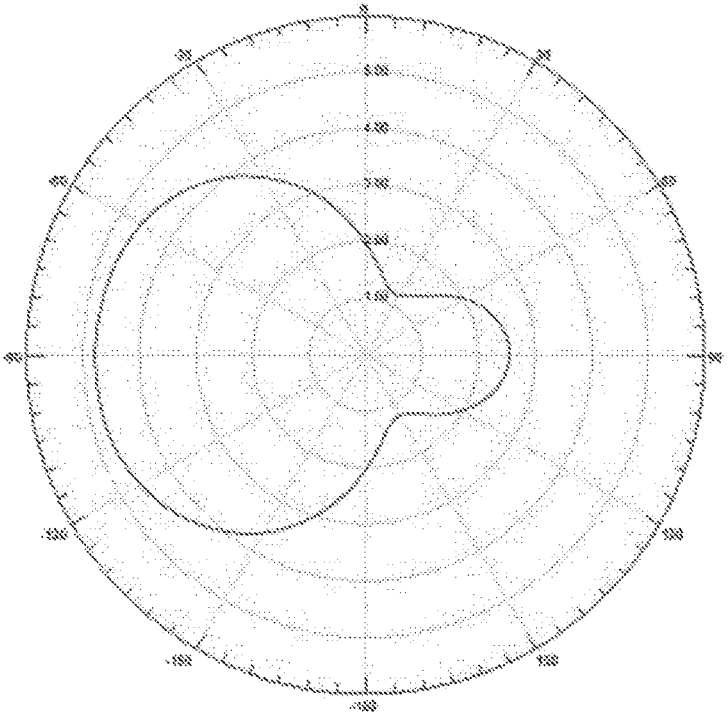
FIGS. 9A-9D each shows a respective horizontal radiation pattern of an antenna unit of the intelligent antenna system of FIG. 1 when all but one reflector of the antenna unit is grounded.
Figure 9B:
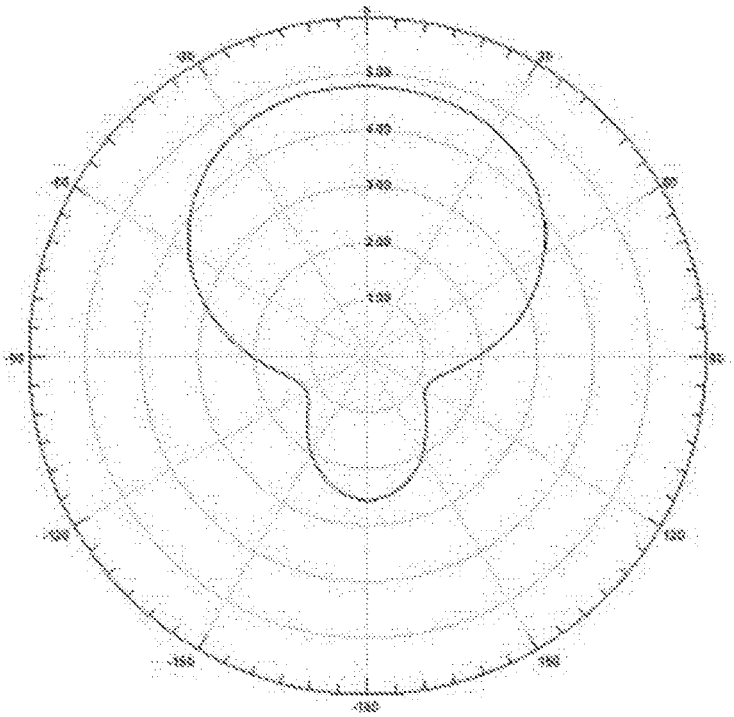
Figure 9C:
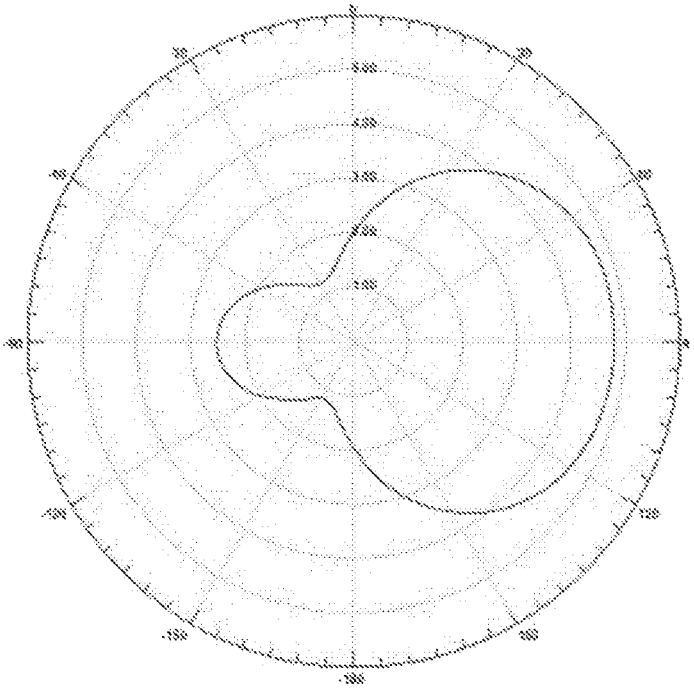
Figure 9D:
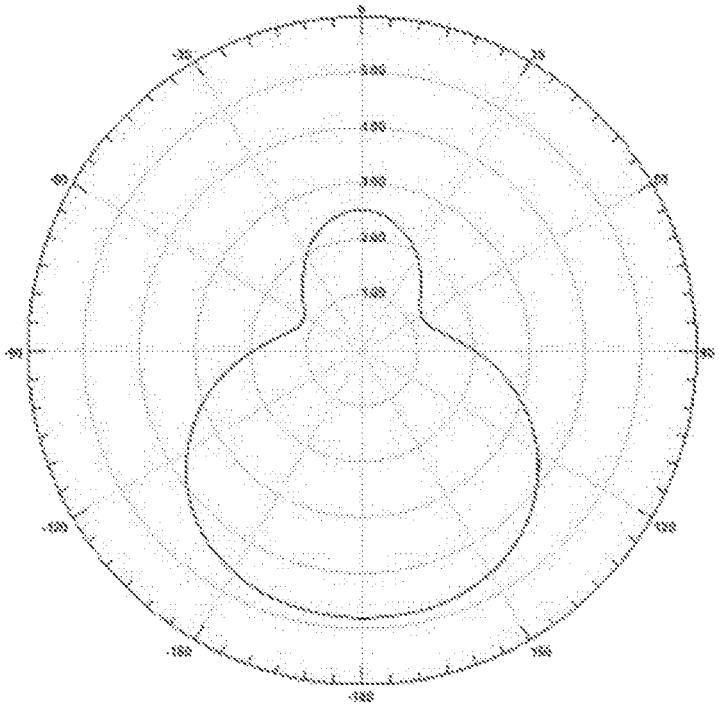

FIG. 6 shows a horizontal radiation pattern of an antenna unit having four reflectors, such as first antenna unit 110 of FIGS. 4A and 4B or second antenna unit 120 of FIGS. 5A-5C. Specifically, the horizontal radiation pattern shown in FIG. 6 corresponds to a switch combination that causes none of the reflectors of the antenna unit to be grounded. That is, all the diodes are turned off such that no reflector of the antenna unit is electrically coupled to the electrical ground of the antenna unit. The antenna unit is operating in an omnidirectional mode, and the horizontal radiation pattern approximates a shape of a circle.

Each of FIGS. 7A-7D shows a horizontal radiation pattern of an antenna unit having four reflectors, such as first antenna unit 110 of FIGS. 4A and 4B or second antenna unit 120 of FIGS. 5A-5C. Specifically, the horizontal radiation pattern shown in each of FIGS. 7A-7D corresponds to a switch combination that causes none but one reflector of the antenna unit to be grounded. That is, only one diode is turned on, while the other three diodes are turned off. Moreover, each of FIGS. 7A-7D corresponds to a respectively different diode being turned on, i.e., to a respectively different reflector (the one reflector connected with the diode being turned on) being coupled to the electrical ground. As can be seen, the horizontal radiation patterns of FIGS. 7A-7D are no longer omnidirectional, but each has a respectively different primary radiation direction in which the EM wave is radiated most strongly. The primary radiation direction of each of the horizontal radiation patterns of FIGS. 7A-7D opposes the respective reflector connected with the diode that is being turned on.

Each of FIGS. 8A-8F shows a horizontal radiation pattern of an antenna unit having four reflectors, such as first antenna unit 110 of FIGS. 4A and 4B or second antenna unit 120 of FIGS. 5A-5C. Specifically, the horizontal radiation pattern shown in each of FIGS. 8A-8D corresponds to a switch combination that causes two and only two adjacent reflectors of the antenna unit to be grounded. That is, the diodes of two adjacent reflectors are turned on, while the other two diodes are turned off. As can be seen, each of the horizontal radiation patterns of FIGS. 8A-8D has a respectively different primary radiation direction in which the EM wave is radiated most strongly. Likewise, the primary radiation direction opposes the two adjacent reflectors connected with the diodes that are being turned on. For each of FIGS. 8E and 8F, the horizontal radiation pattern corresponds to a switch combination that causes two and only two opposite reflectors of the antenna unit to be grounded. That is, the diodes of two opposite reflectors are turned on, while the other two diodes are turned off. As can be seen, each of the horizontal radiation patterns of FIGS. 8E and 8F also has a respectively different primary radiation direction in which the EM wave is radiated most strongly. The primary radiation direction is aligned with the two reflectors that are not coupled to the electrical ground of the antenna unit.

Each of FIGS. 9A-9D shows a horizontal radiation pattern of an antenna unit having four reflectors, such as first antenna unit 110 of FIGS. 4A and 4B or second antenna unit 120 of FIGS. 5A-5C. Specifically, the horizontal radiation pattern shown in each of FIGS. 9A-9D corresponds to a switch combination that causes all but one reflector of the antenna unit to be grounded. That is, only one diode is turned off, while the other three diodes are turned on. As can be seen, each of the horizontal radiation patterns of FIGS. 9A-9D has a respectively different primary radiation direction in which the EM wave is radiated most strongly. The primary radiation direction points to the only reflector that is not coupled to the electrical ground of the antenna unit. The EM wave is radiated with less power in directions other than the primary radiation direction.

Figure 10:
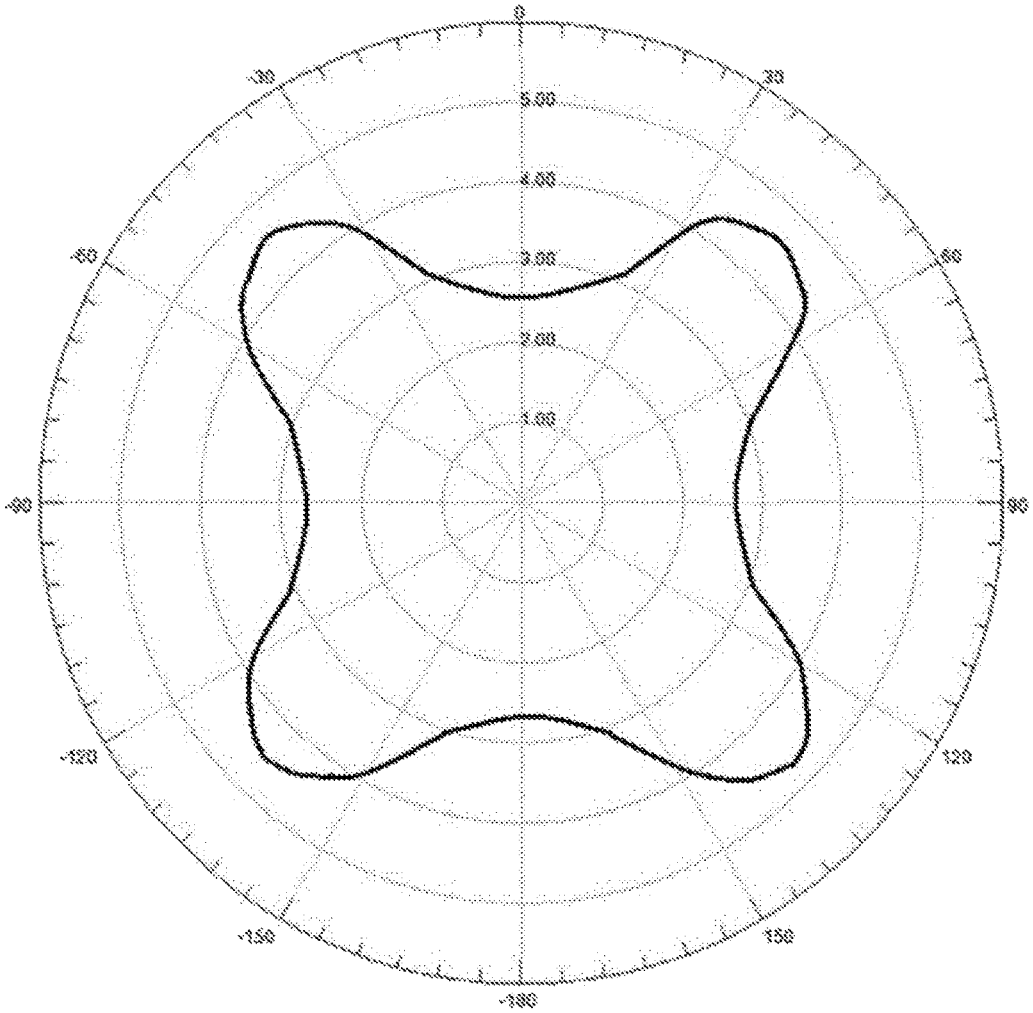
FIG. 10 shows a horizontal radiation pattern of an antenna unit of the intelligent antenna system of FIG. 1 when every reflector of the antenna unit is grounded.

FIG. 10 shows a horizontal radiation pattern of an antenna unit having four reflectors, such as first antenna unit 110 of FIGS. 4A and 4B or second antenna unit 120 of FIGS. 5A-5C. Specifically, the horizontal radiation pattern shown in FIG. 10 corresponds to a switch combination that causes all of the reflectors of the antenna unit to be grounded. That is, all the diodes are turned on such that every reflector of the antenna unit is electrically coupled to the electrical ground of the antenna unit. As can be seen, the EM wave is radiated most strongly in four diagonal directions substantially between adjacent reflectors.

In some embodiments of the present disclosure, an intelligent antenna system may operate in only one frequency band (such as 2.4 GHz or 5 GHz). In some embodiments of the present disclosure, an intelligent antenna system may operate in three or more frequency bands using three or more kinds of antenna units, each kind working in one of the frequency bands. There may be two, three or more numbers of antenna units in each kind of antenna units. The number of reflectors in each antenna unit may be three, five or other integer numbers.

In some embodiments, the plurality of switches of an antenna unit may include various types of electronically-controllable switching units other than the diodes described above. For example, the plurality of switches may be realized by metal-oxide-semiconductor (MOS) transistors, micro-electro-mechanical-system (MEMS) switches, or the like.

The present disclosure has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the present disclosure as claimed. Accordingly, the scope of the present disclosure is defined by the appended claims rather than the foregoing description of embodiments.

What is claimed is:

1. An antenna system, comprising:

a first group of antenna units operating in a first frequency band and generating a first radiation pattern with a first radiation polarization direction;

a second group of antenna units operating in a second frequency band and generating a second radiation pattern with a second radiation polarization direction, each of the antenna units in the first and second groups including:

an antenna dipole;

a plurality of reflectors disposed around the antenna dipole; and a plurality of switches, each coupling one of the reflectors to an electrical ground;

wherein a radiation pattern of the each of the antenna units changes when any of the switches to the electrical ground is tuned on or off; and a control unit, coupled to each of the antenna units in the first and second groups, configured to change combined first radiation patterns of the antenna units in the first group or combined second radiation patterns of the antenna units in the second group by turning on or off some of all of the switches in each of the first or second group in responding to feedback signal from a terminal device, wherein the first and second radiation polarization directions remains orthogonal regardless how the combined first and second radiation patterns change.

2. The antenna system of claim 1, wherein:

the control unit is configured to place each of the plurality of switches in each of the first or second group in a respective state, the respective state being either an ON state or an OFF state, each of the switches in one of the antenna units is configured to reflect at least a portion of an electromagnetic (EM) signal radiated from an antenna dipole when the each of the switches in the one of the antenna units is placed in the ON state, or each of the switches in one of the antenna units is configured not to substantially reflect the EM signal when the each of the switches in the one of the antenna units is placed in the OFF state, and the control unit changes the first or second combined radiation pattern by changing the first radiation patterns of one or more of the antenna units in the first group or the second radiation patterns of one or more of the antenna units in the second group.

3. The antenna system of claim 1, wherein:

the antenna system is configured to transmit an electromagnetic (EM) signal in one of combined radiation patterns realizable by the antenna system, and the switches are respectively controlled by the control unit to provide a plurality of ON-OFF combinations, each of the ON-OFF combinations corresponding to one of the combined radiation patterns.

4. The antenna system of claim 3, wherein:

the plurality of reflectors are n reflectors, with n being a positive integer greater than or equal to 2, and the plurality of switches comprises $2^n$ ON-OFF combinations, resulting in $2^n$ combined radiation patterns.

5. The antenna system of claim 3, wherein:

the control unit is configured to operate in either a dynamic scanning mode or a normal working mode, when the control unit operates in the dynamic scanning mode, the antenna system performs actions comprising:

scanning through the combined radiation patterns by successively transmitting the EM signal with each of the combined radiation patterns and receiving a respective feedback signal wirelessly from a terminal device; and determining an optimal radiation pattern among the combined radiation patterns based on the respective feedback signal;

determining an optimal ON-OFF combination for the switches to realize the optimal radiation pattern; and when the control unit operates in the normal working mode, the control unit configures the switches to realize the optimal radiation pattern, and the antenna system performs wireless communication with the terminal device with the optimal radiation pattern.

6. The antenna system of claim 5, wherein the control unit operates alternatively between the dynamic scanning mode and the normal working mode such that the optimal radiation mode is constantly updated according to a real-time physical location of the terminal device.

7. The antenna system of claim 1, further comprising:

a fixing device for maintaining each of the reflectors in a respective position in relation to the antenna dipole.

8. The antenna system of claim 1, wherein the reflectors are uniformly disposed surrounding the antenna dipole.

9. The antenna system of claim 1, further comprising:

a substrate comprising a dipole soldering pad and a plurality of reflector soldering pads, wherein:

the at least one antenna unit is disposed on the substrate, the antenna dipole and the plurality of reflectors comprise metal bent with impulse pressure, an end of the antenna dipole is soldered with the dipole soldering pad, and each of the plurality of reflectors has an end soldered with a corresponding one of the plurality of reflector soldering pad.

10. The antenna system of claim 1, wherein:

each of the plurality of switches comprises a diode, each of the plurality of reflectors is electrically coupled to the electrical ground when the corresponding diode is biased to conduct a current in a positive direction of the corresponding diode, and each of the plurality of reflectors is substantially decoupled from the electrical ground electrically when the corresponding diode is biased to substantially prevent a current from flowing in a positive direction of the corresponding diode.

11. The antenna system of claim 1, wherein:

the at least one antenna unit comprises a plurality of antenna units, a first number of antenna units of the plurality of antenna units operate in the first frequency band, and a second number of antenna units of the plurality of antenna units operate in the second frequency band.

12. The antenna system of claim 11, wherein the first frequency band comprises 2.4 gigahertz (GHz), and wherein the second frequency band comprises 5GHz.

* * * * *